US009560467B2

(12) United States Patent
Gorzel et al.

(10) Patent No.: US 9,560,467 B2
(45) Date of Patent: Jan. 31, 2017

(54) 3D IMMERSIVE SPATIAL AUDIO SYSTEMS AND METHODS

(71) Applicant: Google Inc., Mountain View, CA (US)

(72) Inventors: Marcin Gorzel, Dublin (IE); Frank Boland, Dublin (IE); Brian O'Toole, Dublin (IE); Ian Kelly, Dublin (IE)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/937,688

(22) Filed: Nov. 10, 2015

(65) Prior Publication Data

US 2016/0134988 A1 May 12, 2016

Related U.S. Application Data

(60) Provisional application No. 62/078,074, filed on Nov. 11, 2014.

(51) Int. Cl.

| | |
|---|---|
| ***H04S 7/00*** | (2006.01) |
| ***G10L 19/008*** | (2013.01) |
| ***G10L 19/00*** | (2013.01) |

(52) U.S. Cl.

CPC ..... *H04S 7/304* (2013.01); *G10L 19/00* (2013.01); *G10L 19/008* (2013.01); *H04S 7/306* (2013.01); *H04S 2400/03* (2013.01); *H04S 2400/11* (2013.01); *H04S 2420/01* (2013.01); *H04S 2420/11* (2013.01)

(58) Field of Classification Search

CPC ..... H04S 7/304; H04S 3/008; G10L 19/008
USPC ..... 381/1, 17, 18, 22, 23, 27, 74, 300, 303,381/310, 57, 63, 92, 307, 309; 434/252; 704/229, 500; 348/77
See application file for complete search history.

(56) References Cited

U.S. PATENT DOCUMENTS

| | | | | |
|---|---|---|---|---|
| 6,224,386 | B1 * | 5/2001 | Suzuki | A63B 69/3635 434/247 |
| 6,577,736 | B1 * | 6/2003 | Clemow | H04R 5/02 381/17 |
| 6,751,322 | B1 * | 6/2004 | Carlbom | H04S 3/00 381/61 |
| 7,158,642 | B2 * | 1/2007 | Tsuhako | H04R 5/02 381/17 |
| 7,231,054 | B1 * | 6/2007 | Jot | H04S 3/00 381/18 |
| 7,720,240 | B2 * | 5/2010 | Wang | H04S 3/002 381/309 |
| 7,936,887 | B2 * | 5/2011 | Smyth | H04S 7/304 381/309 |

(Continued)

FOREIGN PATENT DOCUMENTS

WO WO 2014/001478 A1 1/2014

OTHER PUBLICATIONS

ISR & Written Opinion, dated Jan. 20, 2016, in related application No. PCT/US2015/059915.

*Primary Examiner* — Gerald Gauthier
(74) *Attorney, Agent, or Firm* — Brake Hughes Bellermann LLP

(57) ABSTRACT

Provided are methods and systems for delivering three-dimensional, immersive spatial audio to a user over a headphone, where the headphone includes one or more virtual speaker conditions. The methods and systems recreate a naturally sounding sound field at the user's ears, including cues for elevation and depth perception. Among numerous other potential uses and applications, the methods and systems of the present disclosure may be implemented for virtual reality applications.

20 Claims, 7 Drawing Sheets

(56) References Cited

U.S. PATENT DOCUMENTS 8,041,041 B1 * 10/2011 Luo ..... G10L 19/008 381/19
8,081,762 B2 * 12/2011 Ojala ..... G10L 19/008 381/1
8,255,212 B2 * 8/2012 Villemoes ..... H03H 17/0272 704/229
8,374,365 B2 * 2/2013 Goodwin ..... G10L 19/173 381/17
8,687,829 B2 * 4/2014 Hilpert ..... H04R 5/02 381/1
9,009,057 B2 * 4/2015 Breebaart ..... H04S 3/004 704/500
9,190,065 B2 * 11/2015 Sen ..... G10L 19/008
9,204,236 B2 * 12/2015 Tsingos ..... H04S 3/008
9,226,089 B2 * 12/2015 Mundt ..... H04S 3/004
9,332,373 B2 * 5/2016 Beaton ..... H04S 7/307
2006/0045294 A1 3/2006 Smyth
2009/0177479 A1 * 7/2009 Yoon ..... G10L 19/008 704/500
2009/0262947 A1 * 10/2009 Karlsson ..... H04S 7/30 381/17
2010/0215199 A1 * 8/2010 Breebaart ..... H04S 5/005 381/310
2010/0246832 A1 9/2010 Villemoes et al.
2011/0013790 A1 * 1/2011 Hilpert ..... G10L 19/008 381/300
2011/0242305 A1 * 10/2011 Peterson ..... G01S 15/003 348/77
2012/0039477 A1 2/2012 Schijers et al.
2012/0128174 A1 * 5/2012 Tammi ..... H04S 1/002 381/92
2012/0314872 A1 * 12/2012 Tan ..... H04N 5/60 381/17
2014/0133683 A1 * 5/2014 Robinson ..... H04S 3/008 381/303
2014/0270184 A1 * 9/2014 Beaton ..... H04S 7/307 381/17
2014/0350944 A1 * 11/2014 Jot ..... G10L 19/008 704/500
2015/0230040 A1 * 8/2015 Squires ..... H04S 7/306 381/303
2015/0245153 A1 * 8/2015 Malak ..... H03G 7/00 381/57
2015/0350804 A1 * 12/2015 Crockett ..... H04R 5/02 381/307
2016/0029139 A1 * 1/2016 Lee ..... H04S 5/00 381/17
2016/0050508 A1 * 2/2016 Redmann ..... H04S 7/30 381/303
2016/0064003 A1 * 3/2016 Mehta ..... G10L 19/008 381/23
2016/0134988 A1 * 5/2016 Gorzel ..... H04S 7/304 381/22

* cited by examiner

500

3D IMMERSIVE SPATIAL AUDIO SYSTEMS AND METHODS

The present application claims priority to U.S. Provisional Patent Application Ser. No. 62/078,074, filed Nov. 11, 2014, the entire disclosure of which is hereby incorporated by reference.

BACKGROUND

In many situations it is desirable to generate a sound field that includes information relating to the location of signal sources (which may be virtual sources) within the sound field. Such information results in a listener perceiving a signal to originate from the location of the virtual source, that is, the signal is perceived to originate from a position in 3-dimensional space relative to the position of the listener. For example, the audio accompanying a film may be output in surround sound in order to provide a more immersive, realistic experience for the viewer. A further example occurs in the context of computer games, where audio signals output to the user include spatial information so that the user perceives the audio to come, not from a speaker, but from a (virtual) location in 3-dimensional space.

The sound field containing spatial information may be delivered to a user, for example, using headphone speakers through which binaural signals are received. The binaural signals include sufficient information to recreate a virtual sound field encompassing one or more virtual signal sources. In such a situation, head movements of the user need to be accounted for in order to maintain a stable sound field in order to, for example, preserve a relationship (e.g., synchronization, coincidence, etc.) of audio and video. Failure to maintain a stable sound or audio field might, for example, result in the user perceiving a virtual source, such as a car, to fly into the air in response to the user ducking his or her head. Though more commonly, failure to account for head movements of a user causes the source location to be internalized within the user's head.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to processing audio signals containing spatial information.

One embodiment of the present disclosure relates to a method for providing three-dimensional spatial audio to a user, the method comprising: encoding audio signals input from an audio source in a virtual loudspeaker environment into a sound field format, thereby generating sound field data; dynamically rotating the sound field around the user based on collected movement data associated with movement of the user; processing the encoded audio signals with one or more dynamic audio filters; decoding the sound field data into a pair of binaural spatial channels; and providing the pair of binaural spatial channels to a headphone device of the user.

In another embodiment, the method for providing three-dimensional spatial audio further comprises processing sound sources with dynamic room effects based on parameters of the virtual environment in which the user is located.

In another embodiment, processing the encoded audio signals with one or more dynamic audio filters in the method for providing three-dimensional spatial audio includes accounting for anthropometric auditory cues from the surrounding virtual loudspeaker environment.

In yet another embodiment, the method for providing three-dimensional spatial audio further comprises parameterizing spatially recorded room impulse responses into directional and diffuse components.

In still another embodiment, the method for providing three-dimensional spatial audio further comprises processing the directional and diffuse components to generate pairs of decorrelated, diffuse reverb tail filters.

In another embodiment, the method for providing three-dimensional spatial audio further comprises modelling the decorrelated, diffuse reverb tail filters by exploiting randomness in acoustic responses, wherein the acoustic responses include room impulse responses.

Another embodiment of the present disclosure relates to a system for providing three-dimensional spatial audio to a user, the system comprising at least one processor and a non-transitory computer-readable medium coupled to the at least one processor having instructions stored thereon that, when executed by the at least one processor, causes the at least one processor to: encode audio signals input from an audio source in a virtual loudspeaker environment into a sound field format, thereby generating sound field data; dynamically rotate the sound field around the user based on collected movement data associated with movement of the user; process the encoded audio signals with one or more dynamic audio filters; decode the sound field data into a pair of binaural spatial channels; and provide the pair of binaural spatial channels to a headphone device of the user.

In another embodiment, the at least one processor in the system for providing three-dimensional spatial audio is further caused to process sound sources with dynamic room effects based on parameters of the virtual environment in which the user is located.

In another embodiment, the at least one processor in the system for providing three-dimensional spatial audio is further caused to dynamically rotate the sound field around the user while maintaining acoustic cues from the surrounding virtual loudspeaker environment.

In yet another embodiment, the at least one processor in the system for providing three-dimensional spatial audio is further caused to collect the movement data associated with movement of the user from the headphone device of the user.

In still another embodiment, the at least one processor in the system for providing three-dimensional spatial audio is further caused to process the encoded audio signals with the one or more dynamic audio filters while accounting for anthropometric auditory cues from the surrounding virtual loudspeaker environment.

In another embodiment, the at least one processor in the system for providing three-dimensional spatial audio is further caused to parameterize spatially recorded room impulse responses into directional and diffuse components.

In yet another embodiment, the at least one processor in the system for providing three-dimensional spatial audio is further caused to process the directional and diffuse components to generate pairs of decorrelated, diffuse reverb tail filters.

In still another embodiment, the at least one processor in the system for providing three-dimensional spatial audio is further caused to model the decorrelated, diffuse reverb tail filters by exploiting randomness in acoustic responses, wherein the acoustic responses include room impulse responses.

In one or more embodiments, the methods and systems described herein may optionally include one or more of the following additional features: the sound field is dynamically rotated around the user while maintaining acoustic cues from the surrounding virtual loudspeaker environment; the movement data associated with movement of the user is collected from the headphone device of the user; each audio source in the virtual loudspeaker environment is input as a mono input channel together with a spherical coordinate position vector of the audio source; and/or the spherical coordinate position vector identifies a location of the audio source relative to the user in the virtual loudspeaker environment.

Embodiments of some or all of the processor and memory systems disclosed herein may also be configured to perform some or all of the method embodiments disclosed above. Embodiments of some or all of the methods disclosed above may also be represented as instructions embodied on transitory or non-transitory processor-readable storage media such as optical or magnetic memory or represented as a propagated signal provided to a processor or data processing device via a communication network such as an Internet or telephone connection.

Further scope of applicability of the methods and systems of the present disclosure will become apparent from the Detailed Description given below. However, it should be understood that the Detailed Description and specific examples, while indicating embodiments of the methods and systems, are given by way of illustration only, since various changes and modifications within the spirit and scope of the concepts disclosed herein will become apparent to those skilled in the art from this Detailed Description.

BRIEF DESCRIPTION OF DRAWINGS

These and other objects, features, and characteristics of the present disclosure will become more apparent to those skilled in the art from a study of the following Detailed Description in conjunction with the appended claims and drawings, all of which form a part of this specification. In the drawings:

Figure 1:
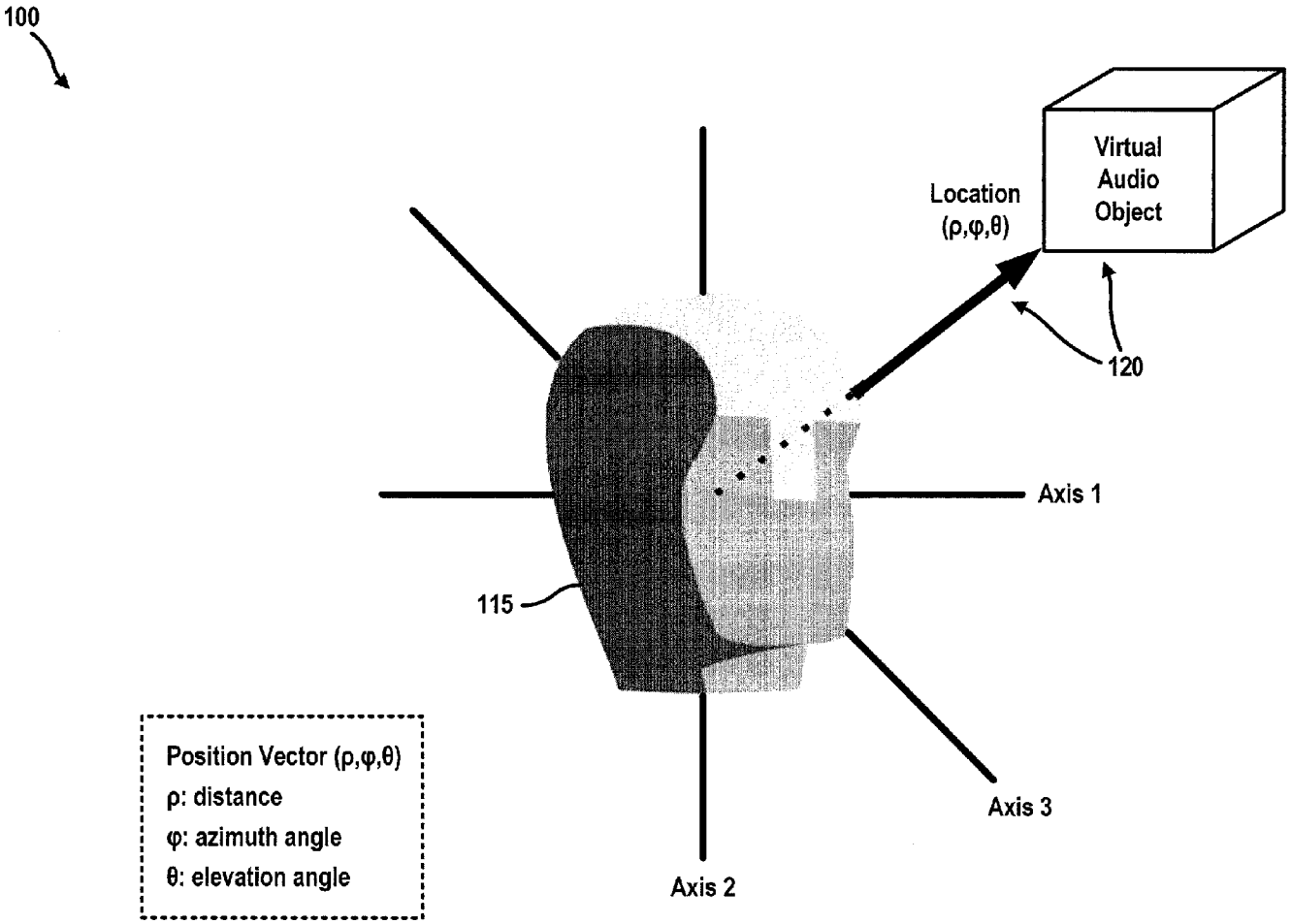
FIG. 1 is a schematic diagram illustrating a virtual source in an example system for providing three-dimensional, immersive spatial audio to a user, including a mono audio input and a position vector describing the source's position relative to the user according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments of the methods and systems of the present disclosure will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include other features not described in detail herein. Additionally, some well-known structures or functions may not be shown or described in detail below, so as to avoid unnecessarily obscuring the relevant description.

In addition to avoiding possible negative user experiences, such as those discussed above, maintenance of a stable sound field induces more effective externalization of the audio field or, put another way, more effectively creates the sense that the audio source is external to the listener's head and that the sound field includes sources localized at controlled locations. As such, it is clearly desirable to modify a generated sound field to compensate for user movement, such as, for example, rotation or movement of the user's head around the x-, y-, and/or z-axis (when using the Cartesian system to represent space).

This problem can be addressed by detecting changes in head orientation using a head-tracking device and, whenever a change is detected, calculating a new location of the virtual source(s) relative to the user, and re-calculating the 3-dimensional sound field for the new virtual source locations. However, this approach is computationally expensive. Since most applications, such as computer game scenarios, involve multiple virtual sources, the high computational cost makes such an approach unfeasible. Furthermore, this approach makes it necessary to have access to both the original signal produced by each virtual source as well as the current spatial location of each virtual source, which may also result in an additional computational burden.

Existing solutions to the problem of rotating or panning the sound field in accordance with user movement include the use of amplitude panned sound sources. However, such existing approaches result in a sound field containing impaired distance cues as they neglect important signal characteristics such as direct-to-reverberant ratio, micro head movements, and acoustic parallax with incorrect wave-front curvature. Furthermore, these existing solutions also give impaired directional localization accuracy as they have to contend with sub-optimal speaker placements.

Maintaining a stable sound field strengthens the sense that the audio sources are external to the listener's head. The effectiveness of this process is technically challenging. One important factor that has been identified is that even small, unconscious head movements help to resolve front-back confusions. In binaural listening, this problem most frequently occurs when non-individualised HRTFs (Head Related Transfer Function) are used. Then, it is usually difficult to distinguish between the virtual sound sources at the front and at the back of the head.

Accordingly, embodiments of the present disclosure relate to methods and systems for providing (e.g., delivering, producing, etc.) three-dimensional, immersive spatial audio to a user. For example, in accordance with at least one embodiment, the three-dimensional, immersive spatial audio may be provided to the user via a headphone device worn by the user. As will be described in greater detail below, the methods and systems of the present disclosure are designed to recreate a naturally sounding sound field at the user's (listener's) ears, including cues for elevation and depth perception. Among numerous other potential uses and applications, the methods and systems of the present disclosure may be implemented for virtual reality (VR) applications.

The methods and systems of the present disclosure are designed to recreate an auditory environment at the user's ears. For example, in accordance with at least one embodiment, the methods and systems (which may be based on various digital signal processing techniques implemented using, for example, a processor configured or programmed to perform particular functions pursuant to instructions from program software) may be configured to perform the following non-exhaustive list of example operations:

(i) Encode the incoming audio signals into a sound field format. This allows for efficient presentation of a higher number of sources.

(ii) Dynamically rotate the complex sound field around the user while maintaining all room (e.g., environmental) acoustic cues. In accordance with at least one embodiment, this dynamic rotation may be controlled by user movement data collected from an associated VR headset of the user.

(iii) Process the encoded audio signals with sets of advanced dynamic audio filters, accounting for anthropometric auditory cues with emphasis on externalization.

(iv) Decode the sound field data into a pair of binaural spatial headphone channels. These can then be fed to the user's headphones just like conventional left/right audio channels.

(v) Process the sound sources with dynamic room effects, designed to mimic the parameters of the virtual environment in which the source and listener pair are located.

In accordance with at least one embodiment, the audio system described herein uses native C++ code to provide optimum performance and grant the widest range of targetable platforms. It should be appreciated that other coding languages can also be used in place of or in addition to C++. In such a context, the methods and systems provided may be integrated, for example, into various 3-dimensional (3D) video game development environments in the form of a plugin.

FIG. 1 shows a virtual source 120 in an example system and surrounding virtual environment 100 for providing three-dimensional, immersive spatial audio to a user. In accordance with at least one embodiment, the virtual source 120 may include a mono audio input signal and a position vector (ρ, ϕ, θ) describing the position of the virtual source 120 relative to the user 115.

Figure 2:
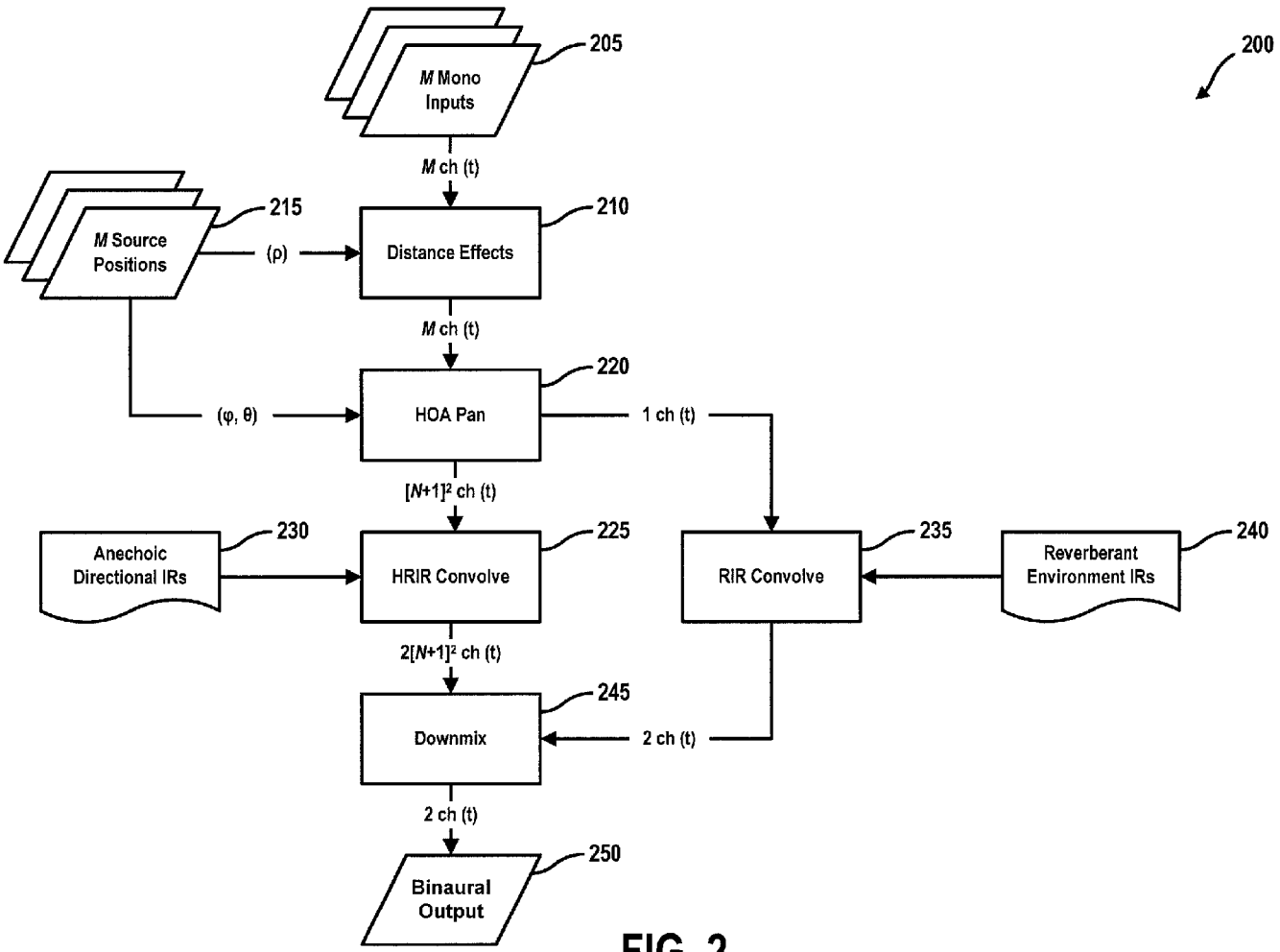
FIG. 2 is a block diagram illustrating an example method and system for providing three-dimensional, immersive spatial audio to a user according to one or more embodiments described herein.

FIG. 2 is an example method and system (200) for providing three-dimensional, immersive spatial audio to a user, in accordance with one or more embodiments described herein. Each source in the virtual environment is input as a mono input (205) channel along with a spherical coordinate source position vector (ρ, ϕ, θ) (215) describing the source's location relative to the listener in the virtual environment.

FIG. 1, which is described above, illustrates how the inputs (205 and 215) in the example system 200, namely, the mono input channel 205 and spherical coordinate source position vector 215, relate to a virtual source (e.g., virtual source 120 in the example shown in FIG. 1).

In FIG. 2, M denotes the number of active sources being rendered by the system and method at any one time. In accordance with at least one embodiment, each of blocks 210 (Distance Effects), 220 (HOA Pan), 225 (HRIR (Head Related Impulse Response) Convolve), 235 (RIR (Room Impulse Response) Convolve), and 245 (Downmix) represents a processing step in the system 200, while blocks 230 (Anechoic Directional IRs) and 240 (Reverberant Environment IRs) denote dynamic impulse responses, which may be pre-recorded, and which act as further inputs to the system 200. The system 200 is configured to generate a two channel binaural output (250).

The following description provides details about one or more components in an example system for providing three-dimensional, immersive spatial audio to a user, in accordance with one or more embodiments described herein. It should be understood, however, that one or more other components may also be included in such a system in addition to or instead of one of or more of the example components described.

Encoder Component

In accordance with at least one embodiment, the M incoming mono sources (205) are encoded into a sound field format so that they can be panned and spatialized about the listener. Within the system (e.g., system 200 shown in FIG. 2), an instance of the class AmbisonicSource (315) is created for each virtual object which emits sound, as illustrated in the example class diagram 300 shown in FIG. 3. This object then takes care of distance effects, gain coefficients for each of the ambisonic channels, recording current source location, and the "playing" of the source audio.

Panning Component

A core class, referred to herein as AmbisonicRenderer (320), may contain one or more of the processes for rendering each AmbisonicSource (315). As such, the AmbisonicRenderer (320) class may be configured to perform, for example, panning (e.g., Pan( )), convolving (e.g., Convolve( )), reverberation (e.g., Reverb( )), downmixing (e.g., Downmix( )), and various other operations and processes. Additional details about the panning, convolving, and downmixing processes will be provided in the sections that follow below.

In accordance with at least one embodiment of the present disclosure, the panning process (e.g., Pan( ) in the AmbisonicRenderer (320) class) is configured to correctly place each AmisonicSource about the listener, such that these auditory locations exactly match the "visual" locations in the VR scene. The data from both VR object positions and listener position/orientation are used in this determination. In one example, the listener position/orientation data can in part be updated by a VR mounted helmet in the case where such a device is being used.

The panning operation (e.g., function) Pan( ) weights each of the channels in a spatial audio context, accounting for head rotation. These weightings effect the compensatory panning need in order to maintain the system's virtual loudspeakers in stationary positions despite the turning of the listener's head. In addition to the head rotation angle, the gain coefficient selected should also be offset according to the position of each of the virtual speakers.

Convolution Component

Figure 3:
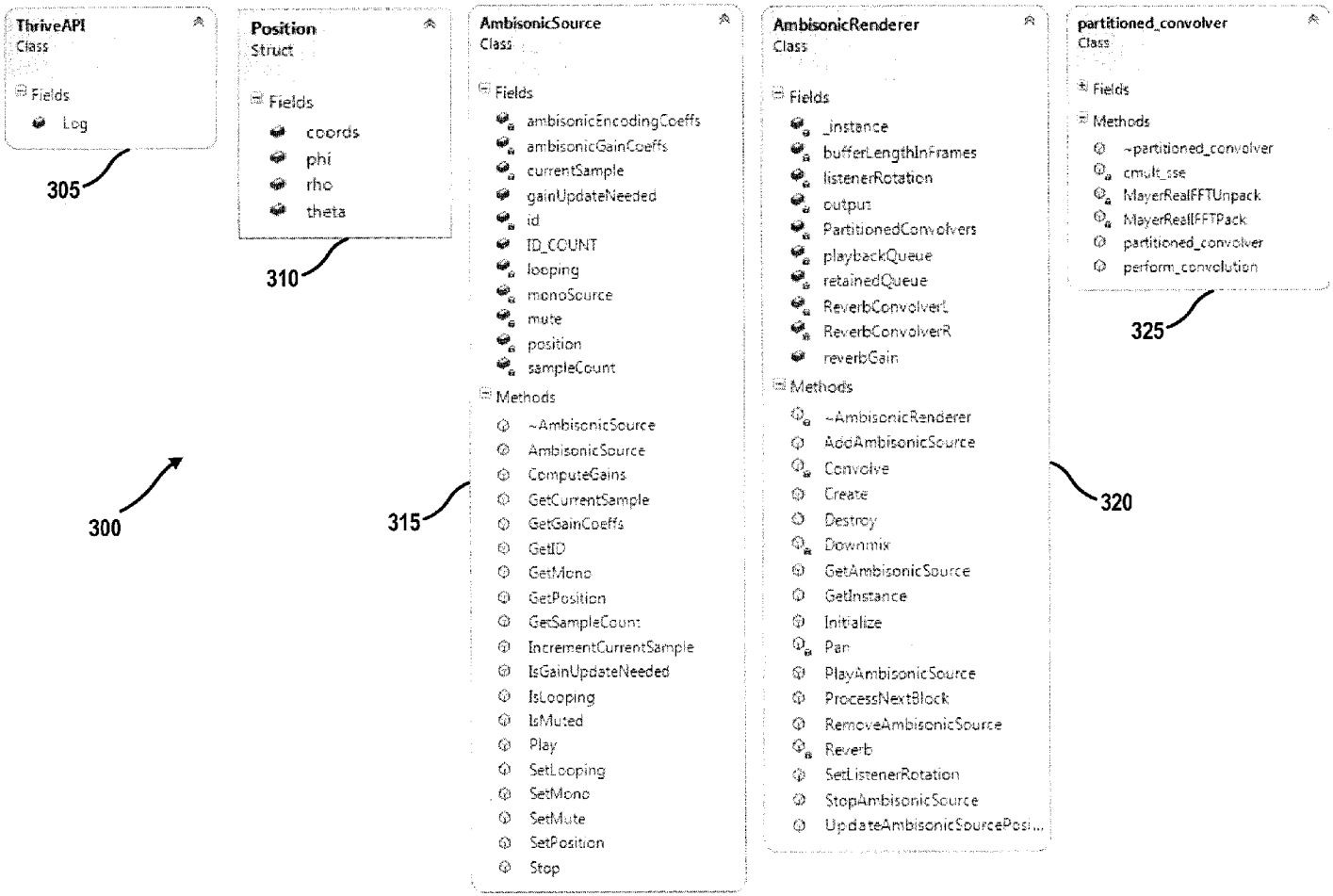
FIG. 3 is a block diagram illustrating example class data and components for operating a system to provide three-dimensional, immersive spatial audio to a user according to one or more embodiments described herein.

In accordance with one or more embodiments described herein, the convolution component of the system is encapsulated in a partitioned convolver class 325 (in the example class diagram 300 shown in FIG. 3). Each filter to be implemented necessitates an instance of this class which may be configured to handle all buffering and domain transforms intrinsically. This modular nature allows optimizations and changes to be made to the convolution engine without the need to alter any of the rest of the system.

One or more of the spatialization filters used in the system may be pre-recorded, thereby allowing for careful selection of HRIR distances and the ability to ensure that there was no head movement allowed during the recording process, as is the case with some publicly available HRIR datasets. Further, the HRIRs used in the example system described herein have also been recorded in conditions deemed well-suited to providing basic externalization cues including early, directional part of the room impulse response. Each of the Ambisonic channels is convolved with the corresponding virtual loudspeaker's impulse response pair. The need for a pair of convolutions results from creation of binaural outputs for listening over headphones. Thus, there are two impulse responses required per speaker, or in other words, one for each ear of the user.

Reverberation Component

In accordance with one or more embodiments described herein, the reverberation effects applied in the system are designed for simple alteration by the sound designer using an API associated with the methods and systems of the present disclosure. In addition, the reverberation effects are also designed to automatically respond to changes in environmental conditions in the VR simulation in which the system is utilized. The early reflection and tail effects are dealt with separately in the system. For example, the reverberant tail of a room response may be implemented with a pair of convolutions with de-correlated, exponentially decaying filters, matched to the environments reverberation time.

Downmix Component

In the Downmix( ) function/process, the virtual loudspeaker channels are down mixed into a pair of binaural channels, one for each ear. As the panning stage described above (e.g., with respect to the Pan( ) function/process) has already accounted for the combination of each channel to the surround sound effect, the downmix process is rather straightforward. It is in this function also that the binaural reverberation channels are mixed in with the spatialized headphone feeds.

Virtual Soundcard

In accordance with one or more embodiments described herein, a complementary feature/component of the 3D virtual audio system of the present disclosure may be a virtual 5.1 soundcard for capture and presentation of traditional 5.1 surround sound output from, for example, video games, movies, and/or other media delivered over a computing device. Once the audio has been acquired it can be rendered.

As an example use of the systems and methods described herein, software which outputs audio typically detects the capabilities of the audio endpoint device and sets its audio format accordingly, in terms of sampling rate and channel configuration. In order for the system to work with existing playback software, an endpoint must be presented that offers at least an illusion of being able to output surround sound audio. While one solution to this is to require physical surround-sound capable hardware be present in the user's machine, this may incur an additional expense for the user depending on their system, or may be impractical or not even possible in a portable computer.

As such, in accordance with at least one embodiment described herein, the solution to this issue is to implement a virtual sound card in the operating system that has no hardware requirements whatsoever. This allows for maximum compatibility with hardware and software configurations from the user's perspective, as the software is satisfied to output surround sound and the user's system is not obliged to satisfy any esoteric hardware requirements. The virtual soundcard can be implemented in a variety of straightforward ways known to those skilled in the art.

Audio Acquisition

In accordance with one embodiment, communication of audio data between software and hardware may be done using an existing Application Programming Interface. Such an API grants access to the audio data while it is being moved between audio buffers and sent to output endpoints. To gain access to the data a client interface object must be used, which is linked in to the audio device of interest. With such a client interface object, an associated service may be called. This allows the programmer to retrieve the audio packets being transferred in a particular session. These packets can be modified before being output, or indeed can be diverted to another audio device entirely. It is the latter application that is of interest in this case. The virtual audio device is sent surround sound audio which is hooked by the audio capture client and then brought into an audio processing engine. The system's virtual audio device may be configured to offer, for example, six channels of output to the operating system, identifying itself as a 5.1 audio device. In one example, these six channels are sent 16-bit, 44.1 kHz audio by whichever media or gaming application is producing sound. When the previously described audio capture client interface intercepts this audio, a certain number of audio "frames" are returned.

Parameterization of Room Impulse Responses

In accordance with one or more embodiments of the present disclosure, there is provided a method of directional analysis and diffuseness estimation by parameterizing spatially recorded Room Impulse Responses (e.g., SRIRs) into directional and diffuse components. The diffuse subsystem is used to form two de-correlated filter kernels that are applied to the source audio signal at runtime. This approach assumes that the directional components of the room effects are already contained in the Binaural Room Impusle Responses (BRIRs) or modelled separately.

Figure 4:
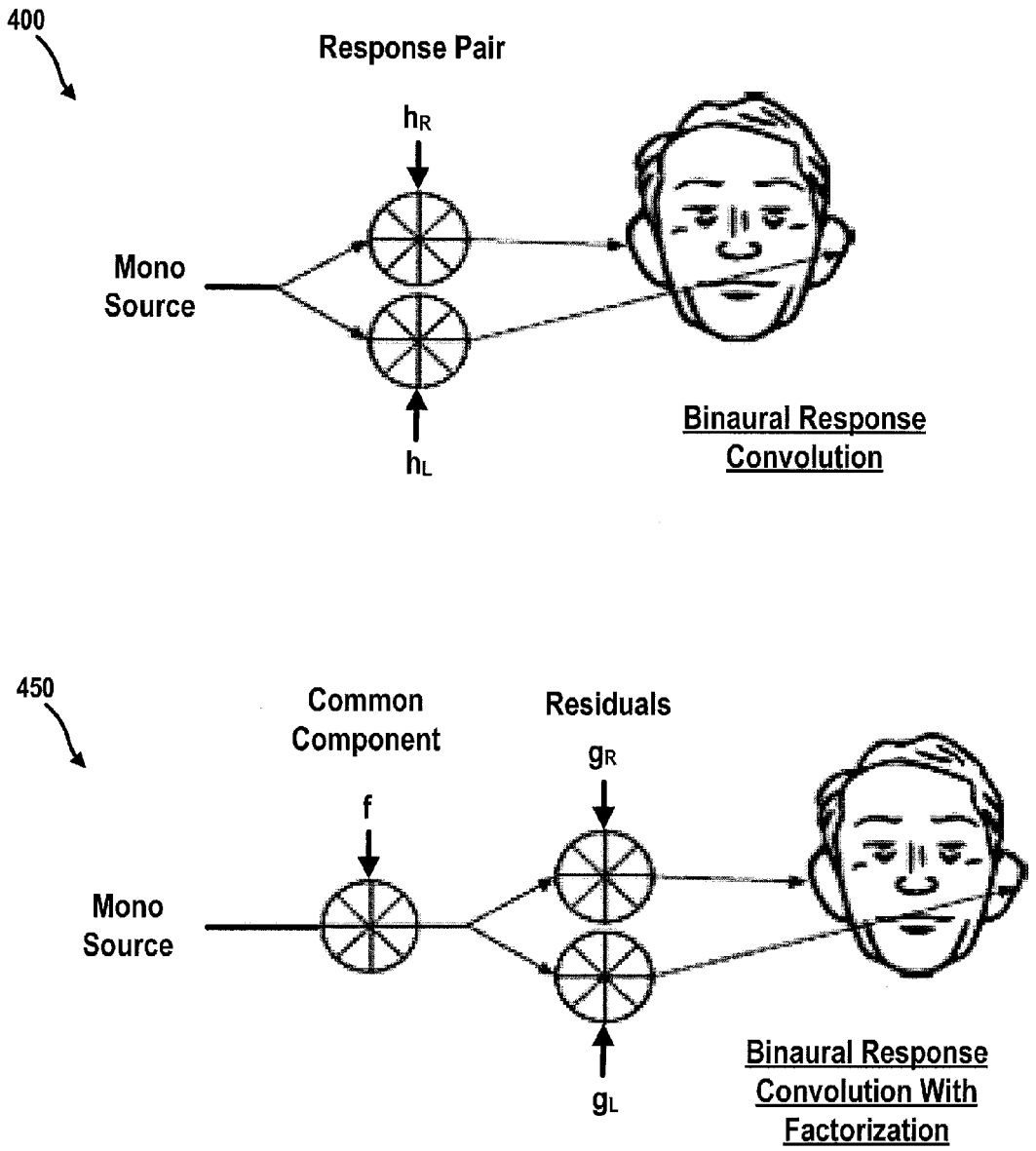
FIG. 4 is a schematic diagram illustrating example filters created during binaural response factorization according to one or more embodiments described herein.

FIG. 4 illustrates example filters that may be created during a binaural response factorization process, in accordance with one or more embodiments described herein. A convolution of the residuals and the common factor will give back the original binaural response, $h\phi=f*g\phi$. Overall, the two large convolutions (as shown in the example arrangement 400) can be replaced with three short convolutions (as shown in the example arrangement 450).

The diffuseness estimation method is based on the time-frequency derivation of an instantaneous acoustic intensity vector which describes the current flow of acoustic energy in a particular direction:

$$I(t)=p(t)u(t), \tag{1}$$

where I(t) denotes sound intensity, p(t) is acoustic pressure, and u(t) is particle velocity. It is important to note that I(t) and u(t) are vector quantities with their components acting in x, y, and z directions. The Ambisonic B-Format signals can comprise of one omnidirectional components (W) that can be used to estimate acoustic pressure, and also three directional components (X, Y, and Z) that can be used to approximate acoustic velocity in the required direction x, y, and z:

$$p(t)=w(t) \tag{2}$$

and $$u(t) = \frac{1}{\sqrt{2}\,z_0}(x(t)i + y(t)j + z(t)k), \tag{3}$$

where i, j, and k are cartesian unit vectors, x(t), y(t), and z(t) are first order Ambisonics signals and $Z_0$ is the specific acoustic impedance of air.

Thus, the instantaneous acoustic intensity vector in the frequency domain, approximated with B-Format signals can be expressed as:

$$I(\omega) = \frac{\sqrt{2}}{z_0}\mathrm{Re}\{W^*(\omega)U(\omega)\}, \tag{4}$$

where W(ω) and U(ω) are the short-term Fourier Transform (STFT) of the w(t) and u(t) time domain signals, and * denotes complex conjugate. The direction of the vector I(ω) corresponds to the direction of the flow of acoustic energy. That is why the plane wave source can be assumed in the −I(ω) direction. The horizontal direction of arrival ϕ can be then calculated as:

$$\phi(\omega) = \arctan\left(\frac{-I_y(\omega)}{-I_x(\omega)}\right) \tag{5}$$

and the vertical direction:

$$\theta(\omega) = \arctan\left(\frac{-I_z(\omega)}{\sqrt{I_x^2(\omega) + I_y^2(\omega)}}\right), \tag{6}$$

where $I_x(\omega)$, $I_y(\omega)$, and $I_z(\omega)$ are the I(ω) vector components in the x, y, and z directions, respectively.

Now, in order to be able to extract a directional portion from the B-Format Spatial Room Impulse Response (SRIR), the diffuseness coefficient can be estimated that is given by the magnitude of short-term averaged intensity referred to the overall energy density:

$$\psi(\omega) = 1 - \frac{\sqrt{2}\,\|\mathrm{Re}\{W^*(\omega)U(\omega)\}\|}{|W(\omega)|^2 + |U(\omega)|^2/2}. \tag{7}$$

The output of the analysis is subsequently subjected to spectral smoothing based on the Equivalent Rectangular Bands (ERB). The extraction of diffuse and non-diffuse parts of the SRIR is done by multiplying the B-format signals by ψ(ω) and $\sqrt{1-\psi(\omega)}$, respectively.

In the following example, a full SRIR has been processed in order to achieve a truly diffuse response. The SRIR used was measured in a large cathedral 32 meters (m) from the sound source using a Soundfield microphone.

Different SRIRs may require different parameter values in the analysis in order to come up with optimal results. Although no evaluation method of the effectiveness of the directional analysis has been proposed, it is suggested that the resultant SRIR can verified by means of auditioning. So far, all diffuseness estimation parameter values, such as, for example, the lengths of time windows for temporal averaging, the parameters for time frequency analysis, etc., have been defined by informal listening during the development. It should be noted, however, that in accordance with one or more embodiments of the present disclosure, more advanced methods may be used to determine optimal parameter values, such as, for example, formal listening tests and/or auditory modelling.

In accordance with one or more embodiments described herein, an overview of directional analysis parameters, their influence on the analysis output, as well as, possible audible artefacts may be tabulated (e.g., tracked, recorded, etc.). For example, TABLE 1, presented below, includes example selections of parameters to best match the integration in human hearing. In particular, the contents of TABLE 1 include example averaging window lengths used to compute the diffusion estimates at different frequency bands.

TABLE 1

| 100 Hz | 200 Hz | 300 Hz | 400 Hz | 510 Hz | 630 Hz | 770 Hz | 920 Hz | 1080 Hz | 1270 Hz |
|---|---|---|---|---|---|---|---|---|---|
| 200 ms | 200 ms | 200 ms | 175 ms | 137.3 ms | 111.11 ms | 90.9 ms | 76.1 ms | 64.8 ms | 55.1 ms |

| 1480 Hz | 1720 Hz | 2000 Hz | 2320 Hz | 2700 Hz | 3150 Hz | 3700 Hz | 4400 Hz | 5300 Hz |
|---|---|---|---|---|---|---|---|---|
| 47.3 ms | 40.7 ms | 35 ms | 30.2 ms | 25.9 ms | 22.22 ms | 18.9 ms | 15.9 ms | 13.2 ms |

| 6400 Hz | 7700 Hz | 9500 Hz | 12 kHz | 15.5 kHz | 20 kHz |
|---|---|---|---|---|---|
| 10.9 ms | 9.1 ms | 7.4 ms | 5.83 ms | 4.52 ms | 3.5 ms |

Figure 5:
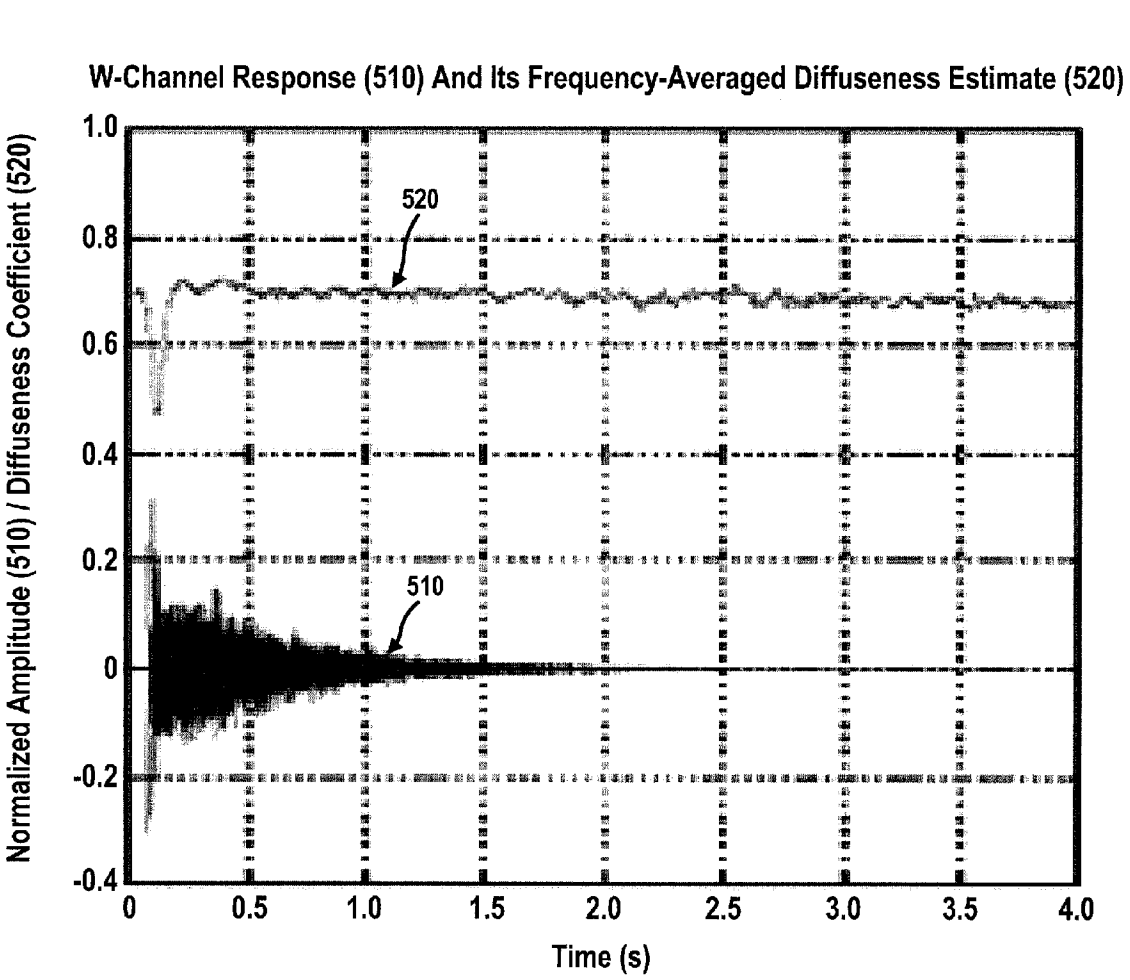
FIG. 5 is a graphical representation illustrating an example response measurement together with an analysis of diffuseness according to one or more embodiments described herein.

FIG. 5 shows the resultant full W component of the SRIR along with the frequency-averaged diffuseness estimate over time. A good indication of the successful process of directional components extraction can be that the diffuseness estimate is low in the early part of the RIR and grows afterwards.

Diffuse Reverberation Tail Pre-Processing

Because diffuse-estimated W, X, Y, and Z channels, described above, typically do not carry important directional information, the methods and systems of the present disclosure utilize the diffuse-estimated channels to form Left and Right de-correlated values. In accordance with at least one embodiment, using this technique, a cardioid microphone (e.g., Mid or M) is facing forward (optionally it can be replaced with an omnidirectional microphone) and a bi-directional microphone (e.g., Side or S) is directed to the sides, so that its rejection zone is directly in the front. In M-S, the stereophonic images are created, for example, by means of matrixing of the M and S signals because in order to derive the stereo output signals with this technique, a simple decoding matrix is needed:

$$L=M+gS \tag{8}$$

$$R=M-gS \tag{9}$$

Real-Time Implementation Using Partitioned Convolution

As with the directional filtering performed by the HRTF convolution, reverberation effects are produced by convolution with appropriate filters. In order to accommodate the inherently long filters required for modelling reverberant spaces, a partitioned convolution system and method are used in accordance with one or more embodiments of the present disclosure. For example, this system segments the reverb impulse responses into blocks which can be processed sequentially in time. Each impulse response partition is uniform in length and is combined with a block from the input stream of the same length. Once an input block has been convolved with an impulse response partition and output, it is shifted to the next partition and convolved once more until the end of the impulse response is reached. This reduces the output latency from the total length of the impulse response to the length of a single partition.

Exploiting Randomness in Acoustic Responses

In the case when recorded SRIRs are unavailable, the diffuse reverberation filters can be modelled by exploiting randomness in acoustic responses. Consider the following model of a room impulse response. Let p[n] be a random signal vector of length N (where "N" is an arbitrary number) whose entries correspond to the coefficients of a random polynomial. Point wise multiply such a signal with a decaying exponential window w[n]=e−βn also of length N. The room impulse response can thus be modelled as:

$$h[n]=p[n]\otimes w[n], \tag{10}$$

where ⊗ is the Hadamard product for vectors.

The reverberation time $RT_{60}$ is the 60 dB decay time for a RIR. In the case of a model signal this can be easily derived from the envelope w[n] and can be obtained by solving:

$$20\log_{10}(e^{-\beta RT_{60}})=-60\ (\text{dB}) \tag{11}$$

to get $$RT_{60}=\frac{1}{\beta}\ln(10^3). \tag{12}$$

It can be deduced that that the roots of p[n] cluster uniformly about the unit circle. That is to say their magnitudes have an expected value of one. Also by the properties of the z-transform, $$H(z)=P(e^{\beta}z)=\Pi_{n=1}^{N}(z+z_n), \tag{13}$$

and thus the magnitudes of the roots of P(z) are scaled by a factor of $e^{\beta}$ to become the roots of H(z), where $z_n$, n∈[1, . . . , N] are the roots of H(z). Equivalently:

$$H(z)=P\left(e^{\frac{\ln(10^3)}{RT_{60}}}z\right). \tag{14}$$

Thus, if the constant β is estimated from the mean of the root magnitudes as $$\beta=-\ln\left(\frac{1}{N}\sum_{n=1}^{N}|z_n|\right) \tag{15}$$

where $z_n$, n∈[1, . . . , N] are the roots of h[n], the reverberation time can be written as $$RT_{60}=\frac{\ln(10^3)}{\ln\sum_{n=1}^{N}|z_n|-\ln(N)}, \tag{16}$$

which depends solely upon the magnitudes of the roots of a given response.

The method outlined above deals with a constant reverberation time across frequency. However in real world acoustic signals this is seldom the case. Looking at RIRs in a roots only manner allows an estimation of the reverberation time in any set of frequency bands of any constant or varying width, with great ease. All that must be done is to modify Equation (16) accordingly, by only counting the roots with argument between $\omega_1$ and $\omega_2$ radians corresponding to $$f_1=F_s\frac{\omega_1}{2\pi}\ \text{to}\ f_1=F_s\frac{\omega_1}{2\pi}\text{Hz},$$

where $F_s$ Hz is the sampling frequency. This can be formulated as:

$$RT_{60}^{\omega_1,\omega_2}=\frac{\ln(10^3)}{\sum_{arg(z_n)\in[\omega_1,\omega_2]}\ln|z_n|-\ln(\#\{z_n:\omega_1\le\arg z_n\le\omega_2\})} \tag{17}$$

Thus, from this estimation of $RT_{60}$ within critical bands is possible.

Viewing the tail of an RIR from the point of view of a Fourier series, one can expect it to appear like random noise, with sinusoids at every frequency, scaled according to a normal distribution and each having randomly distributed phase in turn. With this in mind it is possible to approximately reconstruct the tails of acoustic impulse responses as randomly scaled sums of sinusoids, with decays in each critical band equal to those of real RIRs. Overall, this provides a reliable method of RIR tail simulation.

Let $s_f$ be a sine wave with a frequency off Hz and random phase. Let $\alpha \sim N(0, 1)$ be a random variable with a Gaussian distribution, zero mean, and a standard deviation of one. It is thus possible to define a sequence $$r = \sum_{f=0}^{\frac{F_s}{2}} \alpha s_f \tag{18}$$

that is the sum of the randomly scaled sinusoids. Given a great number of such summed terms, r will in essence be a random vector with a flat band limited spectrum and roots distributed like those of random polynomials.

A second sequence denoted $r_{scale}$ can then be created:

$$r_{scale} = \sum_{f=0}^{\frac{F_s}{2}} \alpha(s_f \otimes e^{-\beta t}) \tag{19}$$

where $\otimes$ denotes a Hadamard product and $\beta$ is chosen in order to give the decay envelope $e^{-\beta t}$ a given $RT_{60}$. This value can then be changed for each critical band (or any other frequency bands) yielding a simulated response tail with frequency dependent $RT_{60}$. The root based $RT_{60}$ estimation method described above may then be used to verify that the root behavior of such a simulated tail matches that of real RIRs.

Figure 6:
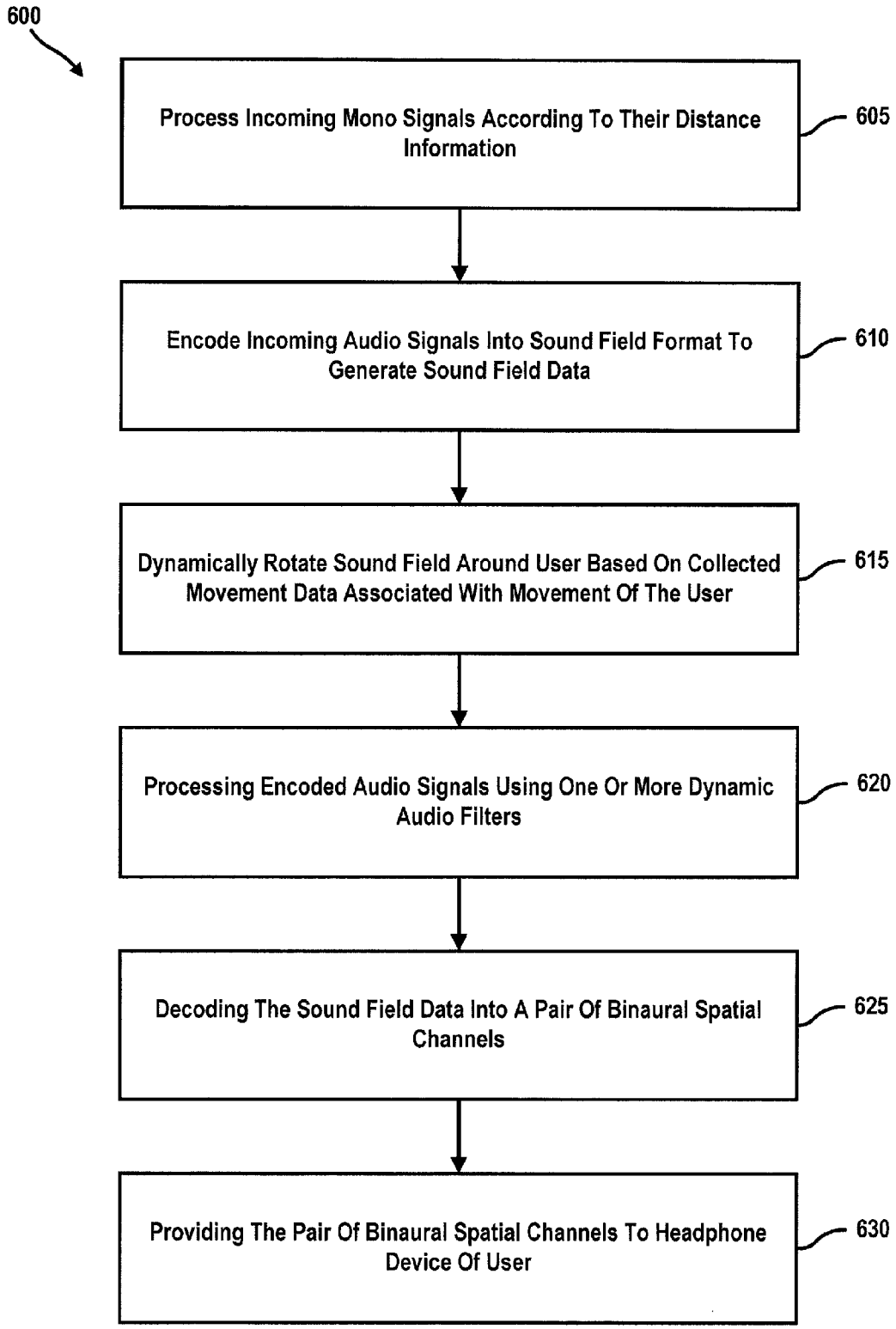
FIG. 6 is a flowchart illustrating an example method for providing three-dimensional, immersive spatial audio to a user according to one or more embodiments described herein.

FIG. 6 illustrates an example process (600) for providing three-dimensional, immersive spatial audio to a user, in accordance with one or more embodiments described herein.

At block 605, incoming audio signals may be encoded into sound field format, thereby generating sound field data. For example, in accordance with at least one embodiment of the present disclosure, each audio source (e.g., sound source) in the virtual loudspeaker environment created around the user may be input as a mono input channel together with a spherical coordinate position vector of the sound source. The spherical coordinate position vector of the sound source identifies a location of the sound source relative to the user in the virtual loudspeaker environment.

At block 610, the sound field may be dynamically rotated around the user based on collected movement data associated with movement of the user (e.g., head movement). For example, in accordance with at least one embodiment, the sound field is dynamically rotated around the user while maintaining acoustic cues of the external environment. In addition, the movement data associated with movement of the user may be collected, for example, from the headphone device of the user.

At block 615, the encoded audio signals may be processed using one or more dynamic audio filters. The processing of the encoded audio signals may be performed while also accounting for anthropometric auditory cues of the external environment surrounding the user.

At block 620, the sound field data (e.g., generated at block 605) may be decoded into a pair of binaural spatial channels.

At block 625, the pair of binaural spatial channels may be provided to a headphone device of the user.

In accordance with one or more embodiments described herein, the example process (600) for providing three-dimensional, immersive spatial audio to a user may also include processing sound sources with dynamic room effects based on parameters of the virtual loudspeaker environment in which the user is located.

Figure 7:
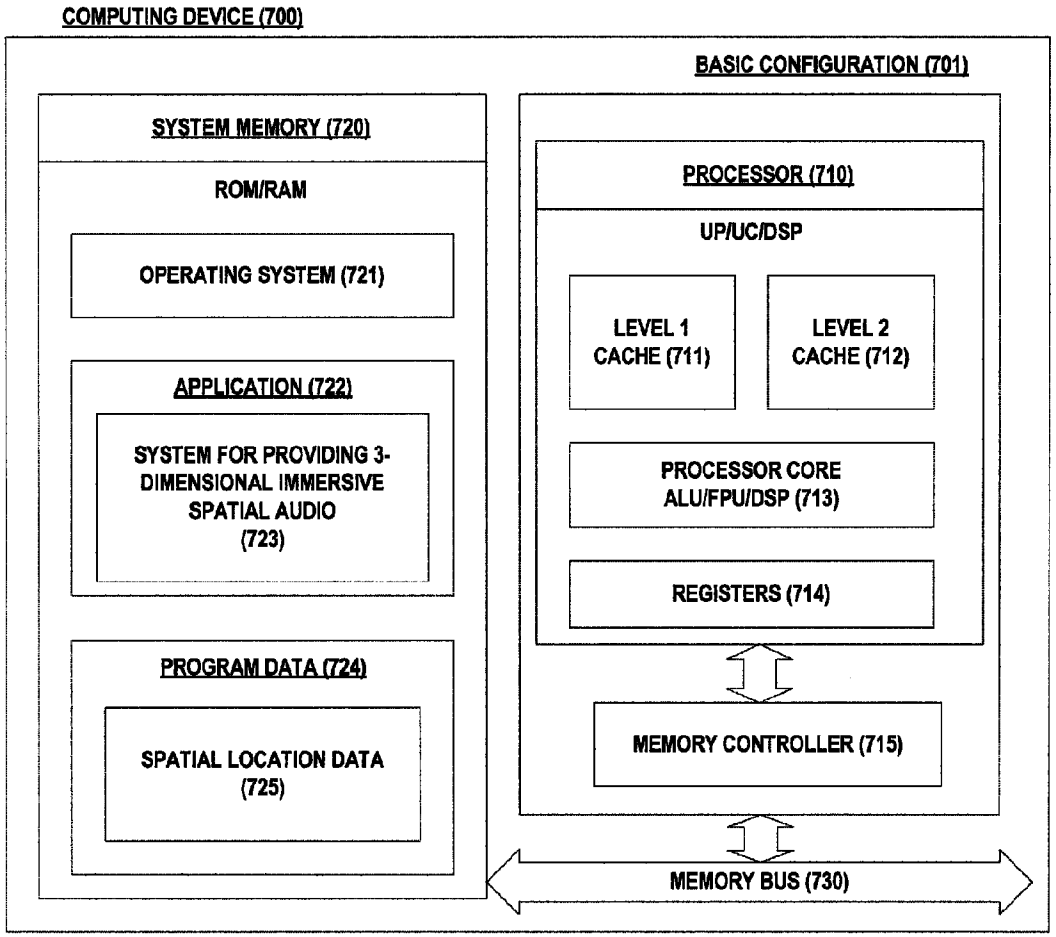
FIG. 7 is a block diagram illustrating an example computing device arranged for providing three-dimensional, immersive spatial audio to a user according to one or more embodiments described herein.

FIG. 7 is a high-level block diagram of an exemplary computer (700) that is arranged for providing three-dimensional, immersive spatial audio to a user, in accordance with one or more embodiments described herein. For example, in accordance with at least one embodiment, computer (700) may be configured to recreate a naturally sounding sound field at the user's ears, including cues for elevation and depth perception. In a very basic configuration (701), the computing device (700) typically includes one or more processors (710) and system memory (720). A memory bus (730) can be used for communicating between the processor (710) and the system memory (720).

Depending on the desired configuration, the processor (710) can be of any type including but not limited to a microprocessor (μP), a microcontroller (μC), a digital signal processor (DSP), or any combination thereof. The processor (710) can include one more levels of caching, such as a level one cache (711) and a level two cache (712), a processor core (713), and registers (714). The processor core (713) can include an arithmetic logic unit (ALU), a floating point unit (FPU), a digital signal processing core (DSP Core), or any combination thereof. A memory controller (715) can also be used with the processor (710), or in some implementations the memory controller (715) can be an internal part of the processor (710).

Depending on the desired configuration, the system memory (720) can be of any type including but not limited to volatile memory (such as RAM), non-volatile memory (such as ROM, flash memory, etc.) or any combination thereof. System memory (720) typically includes an operating system (721), one or more applications (722), and program data (724). The application (722) may include a system for providing three-dimensional immersive spatial audio to a user (723), which may be configured to recreate a naturally sounding sound field at the user's ears, including cues for elevation and depth perception, in accordance with one or more embodiments described herein.

Program Data (724) may include storing instructions that, when executed by the one or more processing devices, implement a system (723) and method for providing three-dimensional immersive spatial audio to a user. Additionally, in accordance with at least one embodiment, program data (724) may include spatial location data (725), which may relate to data about physical locations of loudspeakers in a given setup. In accordance with at least some embodiments, the application (722) can be arranged to operate with program data (724) on an operating system (721).

The computing device (700) can have additional features or functionality, and additional interfaces to facilitate communications between the basic configuration (701) and any required devices and interfaces.

System memory (720) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media can be part of the device (700).

The computing device (700) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (700) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.)

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method for providing three-dimensional spatial audio to a user, the method comprising:

encoding audio signals input from an audio source in a virtual loudspeaker environment into a sound field format, thereby generating sound field data;

dynamically rotating the sound field around the user based on collected movement data associated with movement of the user;

processing the encoded audio signals with one or more dynamic audio filters;

decoding the sound field data into a pair of binaural spatial channels; and providing the pair of binaural spatial channels to a headphone device of the user.

2. The method of claim 1, further comprising:

processing sound sources with dynamic room effects based on parameters of the virtual environment in which the user is located.

3. The method of claim 1, wherein the sound field is dynamically rotated around the user while maintaining acoustic cues from the surrounding virtual loudspeaker environment.

4. The method of claim 1, wherein the movement data associated with movement of the user is collected from the headphone device of the user.

5. The method of claim 1, wherein processing the encoded audio signals with one or more dynamic audio filters includes accounting for anthropometric auditory cues from the surrounding virtual loudspeaker environment.

6. The method of claim 1, wherein each audio source in the virtual loudspeaker environment is input as a mono input channel together with a spherical coordinate position vector of the audio source.

7. The method of claim 6, wherein the spherical coordinate position vector identifies a location of the audio source relative to the user in the virtual loudspeaker environment.

8. The method of claim 1, further comprising:

parameterizing spatially recorded room impulse responses into directional and diffuse components.

9. The method of claim 8, further comprising:

processing the directional and diffuse components to generate pairs of decorrelated, diffuse reverb tail filters.

10. The method of claim 9, further comprising:

modelling the decorrelated, diffuse reverb tail filters by exploiting randomness in acoustic responses, wherein the acoustic responses include room impulse responses.

11. A system for providing three-dimensional spatial audio to a user, the system comprising:

at least one processor; and a non-transitory computer-readable medium coupled to the at least one processor having instructions stored thereon that, when executed by the at least one processor, causes the at least one processor to:

encode audio signals input from an audio source in a virtual loudspeaker environment into a sound field format, thereby generating sound field data;

dynamically rotate the sound field around the user based on collected movement data associated with movement of the user;

process the encoded audio signals with one or more dynamic audio filters;

decode the sound field data into a pair of binaural spatial channels; and provide the pair of binaural spatial channels to a headphone device of the user.

12. The system of claim 11, wherein the at least one processor is further caused to:

process sound sources with dynamic room effects based on parameters of the virtual environment in which the user is located.

13. The system of claim 11, wherein the at least one processor is further caused to:

dynamically rotate the sound field around the user while maintaining acoustic cues from the surrounding virtual loudspeaker environment.

14. The system of claim 11, wherein the at least one processor is further caused to:

collect the movement data associated with movement of the user from the headphone device of the user.

15. The system of claim 11, wherein the at least one processor is further caused to:

process the encoded audio signals with the one or more dynamic audio filters while accounting for anthropometric auditory cues from the surrounding virtual loudspeaker environment.

16. The system of claim 11, wherein each audio source in the virtual loudspeaker environment is input as a mono input channel together with a spherical coordinate position vector of the audio source.

17. The system of claim 16, wherein the spherical coordinate position vector identifies a location of the audio source relative to the user in the virtual loudspeaker environment.

18. The system of claim 11, wherein the at least one processor is further caused to:

parameterize spatially recorded room impulse responses into directional and diffuse components.

19. The system of claim 18, wherein the at least one processor is further caused to:

process the directional and diffuse components to generate pairs of decorrelated, diffuse reverb tail filters.

20. The system of claim 19, wherein the at least one processor is further caused to:

model the decorrelated, diffuse reverb tail filters by exploiting randomness in acoustic responses, wherein the acoustic responses include room impulse responses.

* * * * *